US009644590B2

(12) United States Patent
Peavler et al.

(10) Patent No.: US 9,644,590 B2
(45) Date of Patent: May 9, 2017

(54) FUEL INJECTION PRESSURE PULSATION DAMPENING SYSTEM

(71) Applicant: Cummins Inc., Columbus, IN (US)

(72) Inventors: Paul Peavler, Columbus, IN (US); Donald J. Benson, Columbus, IN (US); Paul Douglas Free, Hope, IN (US); Jeffrey C. Huang, Greenwood, IN (US); Eric Benham, Columbus, IN (US); C. Edward Morris, Jr., Columbus, IN (US)

(73) Assignee: CUMMINS INC., Columbus, IN (US)

( * ) Notice: Subject to any disclaimer, the term of this patent is extended or adjusted under 35 U.S.C. 154(b) by 398 days.

(21) Appl. No.: 14/170,129

(22) Filed: Jan. 31, 2014

(65) Prior Publication Data

US 2015/0219054 A1 Aug. 6, 2015

(51) Int. Cl.

| | |
|---|---|
| ***F02M 55/00*** | (2006.01) |
| ***F02M 69/04*** | (2006.01) |
| ***F02M 47/02*** | (2006.01) |

(52) U.S. Cl.

CPC ..... *F02M 69/04* (2013.01); *F02M 47/027* (2013.01); *F02M 55/008* (2013.01); *F02M 2200/28* (2013.01); *F02M 2200/315* (2013.01)

(58) Field of Classification Search

CPC .... F02M 69/04; F02M 47/027; F02M 55/002; F02M 55/008; F02M 2200/28; F02M 220/315

See application file for complete search history.

(56) References Cited

U.S. PATENT DOCUMENTS

| | | | |
|---|---|---|---|
| 3,976,041 | A | 8/1976 | Mettig et al. |
| 4,028,892 | A | 6/1977 | Hinkle |
| 4,075,991 | A | 2/1978 | Mettig et al. |
| 4,236,492 | A | 12/1980 | Tholen |

(Continued)

FOREIGN PATENT DOCUMENTS

| | | |
|---|---|---|
| DE | 102 57 691 | 6/2004 |
| DE | 10 2007 025617 | 12/2008 |

(Continued)

OTHER PUBLICATIONS

Machine Translation of WO2013111007 (Original supplied by Applicant in the IDS of Aug. 26, 2015).*

(Continued)

*Primary Examiner* — Jacob Amick

(74) *Attorney, Agent, or Firm* — Faegre Baker Daniels LLP

(57) ABSTRACT

A fuel injector has a plurality of injection fuel delivery passages, which transport fuel from a proximate end to an injector cavity near the distal end of the fuel injector, wherein less than a total number of injection fuel delivery passages include an orifice. This configuration provides a reduction in fueling variation from pulse to pulse (multi-pulse) with respect to pulse separation due to pressure variation while allowing a sufficient amount of fuel flow to the injector cavity. Thus, the consistency of Start-Of-Injection (SOI) and opening rate both improve significantly and advantageously. For compactness, the orifices may be positioned in a cover plate used to retain the components of the injection control valve assembly and may further be arranged in an arc segment when viewed along a longitudinal axis.

18 Claims, 7 Drawing Sheets

(56) References Cited

U.S. PATENT DOCUMENTS

| | | | |
|---|---|---|---|
| 4,781,160 | A | 11/1988 | Löhr et al. |
| 4,878,460 | A | 11/1989 | Uchida et al. |
| 5,544,486 | A | 8/1996 | Lu |
| 5,713,330 | A | 2/1998 | Hitomi et al. |
| 7,866,300 | B2 | 1/2011 | Kammerstetter et al. |

FOREIGN PATENT DOCUMENTS

| | | | | |
|---|---|---|---|---|
| DE | 10 2008 044093 | | 5/2010 | |
| DE | 102008044093 | A1 * | 5/2010 | ..... F02M 47/027 |
| GB | 1 592 989 | | 7/1981 | |
| GB | 2 332 478 | | 6/1999 | |
| GB | 2 504 315 | | 1/2014 | |
| JP | 2-16334 | | 1/1990 | |
| WO | 2007/143768 | | 12/2007 | |
| WO | 2013/111007 | | 8/2013 | |
| WO | 2013/174601 | | 11/2013 | |

OTHER PUBLICATIONS

International Search Report and Written Opinion dated May 20, 2015 in International Application No. PCT/US2015/013446.

International Preliminary Report on Patentability dated May 12, 2016 in PCT/US2015/013446.

* cited by examiner

FUEL INJECTION PRESSURE PULSATION DAMPENING SYSTEM

TECHNICAL FIELD

This disclosure relates to pressure pulsation damping devices for fuel injectors.

BACKGROUND

A fuel injector's principal function is to control the flow of injection fuel through an injector cavity into and through one or more injector orifices into a combustion chamber of an internal combustion engine. Because the injection fuel flows at high pressure and high velocity, the start and stop of flow through the injector orifice(s) generates pressure waves or pulsations in the injector cavity. The pressure waves or pulsations in the injection fuel leads to undesirable variations in fuel flow through the injector orifice(s).

SUMMARY

In various embodiments of the disclosure, a fuel injector for injecting fuel at high pressure into a combustion chamber of an internal combustion engine includes an injector body including a longitudinal axis, a fuel delivery circuit, and an injector orifice to discharge fuel from the fuel delivery circuit into the combustion chamber. The fuel delivery circuit includes an injector cavity and a plurality of injection fuel delivery passages extending longitudinally in the injector body in fluid communication with the injector cavity to deliver injection fuel to the injector orifice. Each of the plurality of injection fuel delivery passages includes a passage cross sectional flow area. At least one and less than a total number of the plurality of injection fuel delivery passages includes an orifice having an orifice cross sectional flow area less than the passage cross sectional flow area and is sized to reduce propagation of pressure waves.

In various embodiments, the injector body further includes an upper body portion, a lower body portion in which is positioned the injector cavity, and a cover plate positioned between the upper body portion and the lower body portion. The injection fuel delivery passages extend through the cover plate and at least one orifice being positioned in the cover plate.

The cover plate may be attached to the lower body portion to form a valve assembly. The valve assembly may include a stator housing, and the cover plate places a load on the stator housing. The fuel injector may further include a contact spring positioned longitudinally between the cover plate and the stator housing to impart a spring load to the stator housing.

The plurality of injection fuel delivery passages may be arranged in the cover plate in an arc segment, when viewed along the longitudinal axis, having a first end and a second end. There may be at least three to four injection fuel delivery passages. The number of orifices can range one to three, or the injection fuel delivery passage at the first end and the injection fuel delivery passage at the second end can each include one orifice.

In various other embodiments, the injector body may further include an upper body portion, a lower body portion, and an injection control valve assembly. The injection control valve assembly includes a valve housing positioned along the longitudinal axis in compressive abutment between the upper body portion and the lower body portion to create a force load on the valve housing. The injection control valve assembly further includes a control valve member positioned in the valve housing to move between a first position and a second position. An actuator is positioned in the valve housing and adapted to cause movement of the control valve member between the first and the second positions. The actuator includes a stator housing positioned in the valve housing, and a stator positioned in the stator housing. The injection control valve assembly includes a contact spring positioned longitudinally between the stator housing and the upper body portion to impart a spring load to the stator housing and further includes a cover plate. The cover plate is positioned longitudinally between the upper body portion and the valve housing, and the contact spring is positioned longitudinally between the cover plate and the stator housing. The injection fuel delivery passages extend through the cover plate and at least one orifice being positioned in the cover plate.

In various embodiments, the orifice cross sectional flow area is about 6.25% of the passage cross sectional flow area. Further, in various embodiments, the passage cross sectional flow area of each fuel delivery passage is about the same diameter. Yet further, in various embodiments, each orifice is a sharp-edged orifice.

In some embodiments, the injector body may include a plurality of injector passage surfaces forming the plurality of injection fuel delivery passages. An orifice wall extends transversely and radially inward, and each orifice is formed in one orifice wall. Each orifice wall also includes an orifice surface extending perpendicular to the transverse orifice wall and forming the orifice, and the intersection of each transverse orifice wall and each orifice surface forms an upper edge and a lower edge. The upper edge and the lower edge may have a radius less than 0.002 inches.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
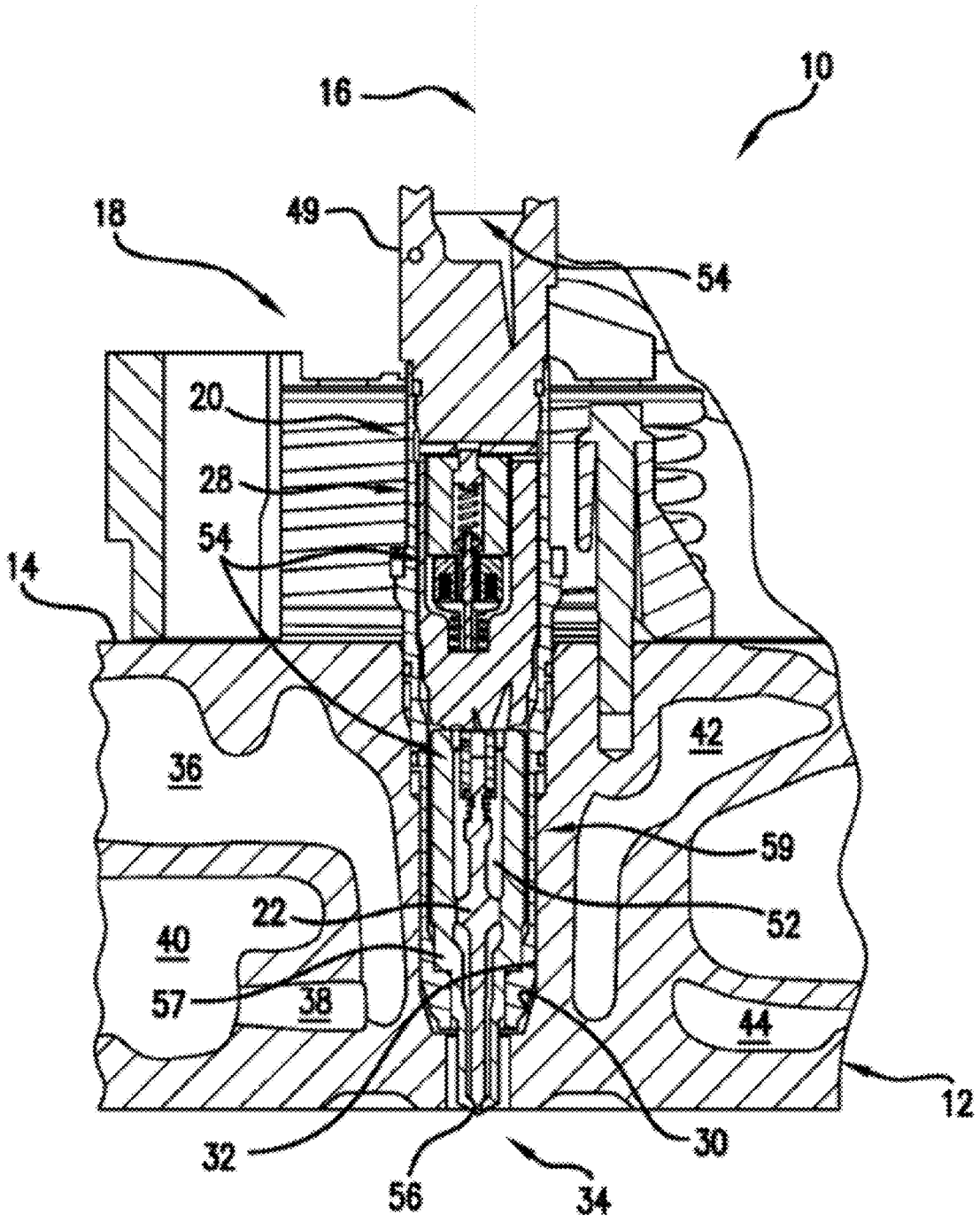
FIG. 1 is a cross-sectional view of a portion of an internal combustion engine including a fuel injector according to an exemplary embodiment of the present disclosure.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

Figure 2:
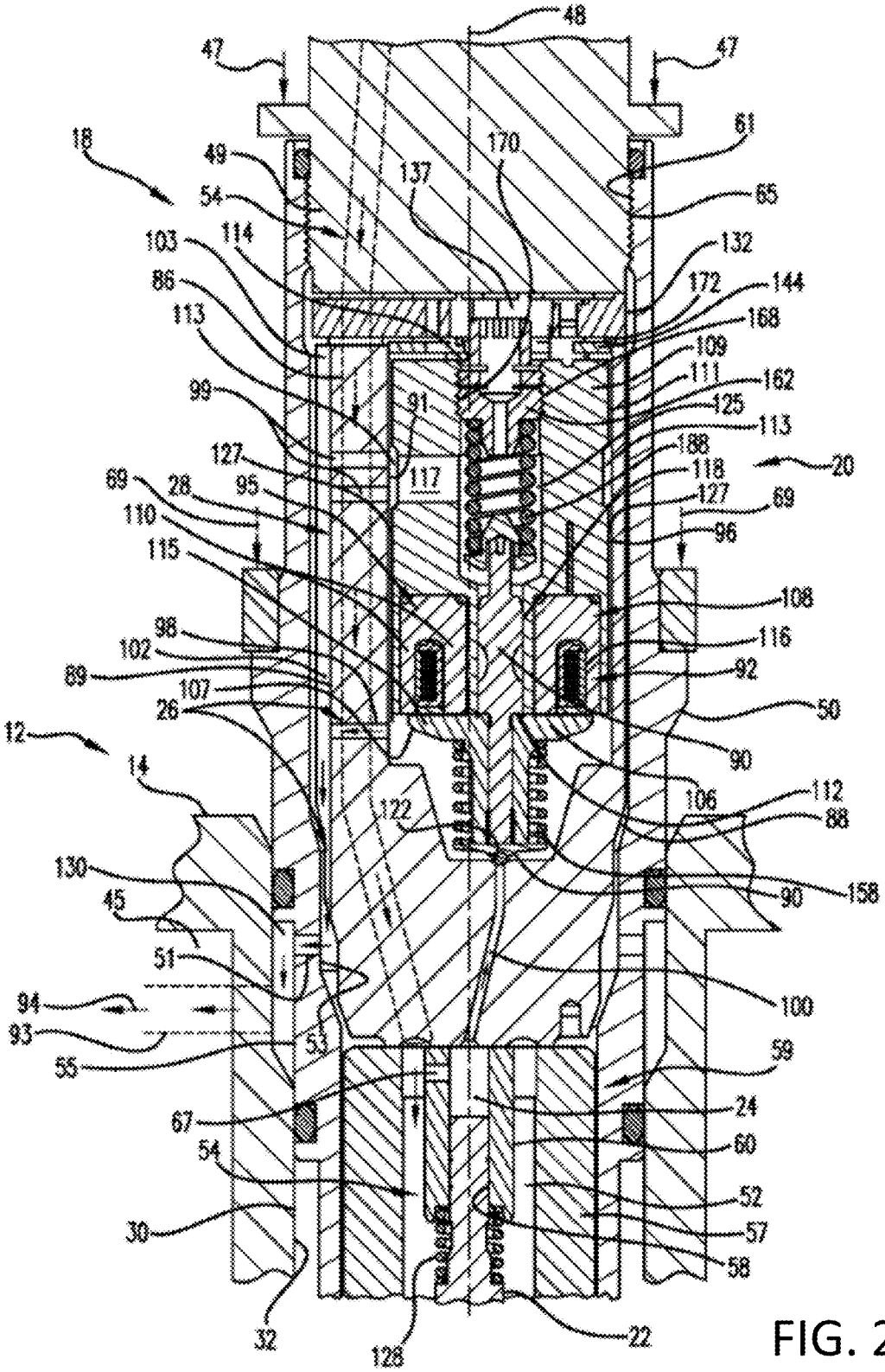
FIG. 2 is a cross-sectional view of a portion of the internal combustion engine showing detail of the fuel injector of FIG. 1.
Figure 3:
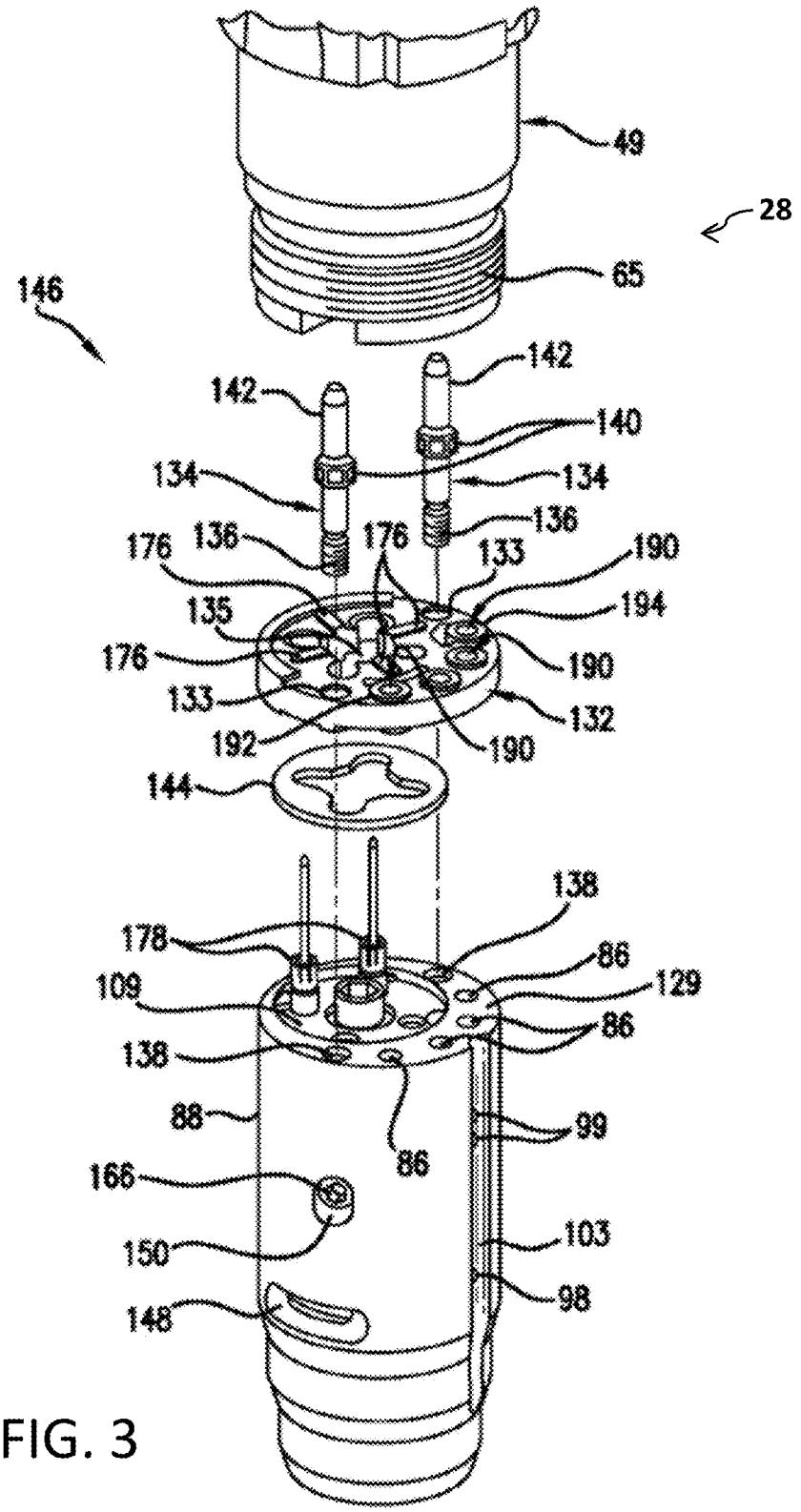
FIG. 3 is a perspective partially exploded view of a control valve assembly and upper body portion of the fuel injector of FIG. 2.

Referring to FIG. 1, a portion of an internal combustion engine is shown generally indicated at 10. Engine 10 includes an engine body 12, which includes an engine block (not shown) and a cylinder head 14 attached to the engine block. Engine 10 also includes a fuel system 16 that includes one or more fuel injectors 18, a fuel pump, a fuel accumulator, valves, and other elements (not shown) that connect to fuel injector 18. Referring to FIGS. 1-3, a fuel injector 18 includes an injector body 20, a needle or nozzle valve element 22, a control volume 24, a drain circuit 26, and an injection control valve assembly 28.

Pressure pulsations or waves in the fuel injector 18 are caused by the start and end of injection fuel flow through one or more injector orifices of the fuel injector 18, and appear as generally sinusoidal variations of pressure in an injector cavity 52 of fuel injector 18. The pressure pulsations or waves lead to variations in fuel flow delivery through the injector orifice(s) 56 and into the combustion chamber 34 of the engine 10 causing variations in the performance of engine 10 including the generation of undesirable and non-uniform noise, vibrations, and harshness (NVH), as well as emissions from the combustion chamber 34. In particular, the magnitude of such pressure pulsations or waves increases with decreasing size of the fuel injector 18. Because reducing the size of the fuel injector 18 is useful in meeting emissions and fuel economy targets, the related increase in pressure pulsations or waves becomes a significant, undesirable side effect. Without providing for a reduction in pressure pulsations or waves, conventional fuel injectors have a practical lower limit to their size.

Figure 5:
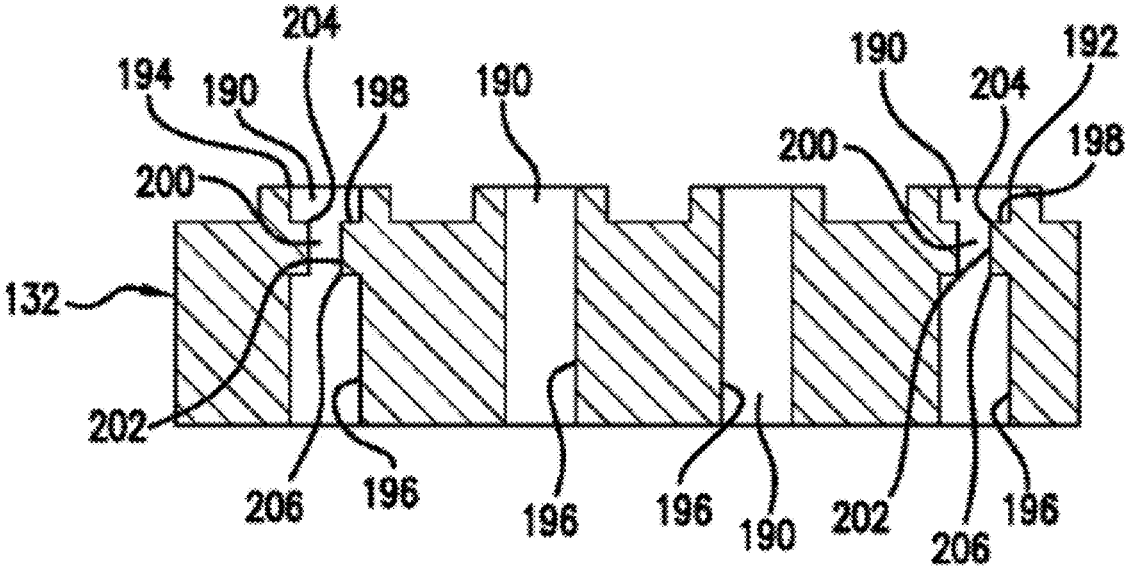
FIG. 5 is a cross-sectional view of a cover plate of the control valve assembly of FIG. 4 along the line 5-5.

Experimental data (shown as graphs in FIGS. 6 and 7 described herein elsewhere) demonstrates that fueling variation from pulse to pulse (multi-pulse) with respect to pulse separation due to pressure variation is reduced when providing a plurality of injection fuel delivery passages 86 to transport fuel from a proximal end of fuel injector 18 to an injector cavity 52 of fuel injector 18 and further providing less than a total number of injection fuel delivery passages 86 with an orifice 200. Providing orifices 200 in less than a total number of injection fuel delivery passages 86 prevents "talking" between the connected volumes, which allows for significant and advantageous improvement in the consistency of Start-Of-Injection (SOI) and opening rate while also allowing for a sufficient amount of fuel flow to the injector cavity 52 based on fueling requirements. Improved consistency and reduced pressure variation provide for an improved lower limit for the size of the fuel injector 18 with less undesirable NVH than a conventional fuel injector. As described in more detail below, in order to maintain an overall compact size of fuel injector 18, orifices 200 are positioned in a cover plate 132 (as shown in FIG. 5) used to retain the components of injection control valve assembly 28.

Perhaps as best shown in FIGS. 1-3, engine body 12 includes a mounting bore 30 formed by an inner wall or surface 32, sized to receive fuel injector 18. Engine body 12 also includes a combustion chamber 34 and one or more coolant passages 36, 38, 40, 42, 44 and 45 arranged about mounting bore 30 and along combustion chamber 34 to provide cooling to fuel injector 18 and components surrounding or adjacent to combustion chamber 34. Combustion chamber 34, only a portion of which is shown in FIG. 1, is positioned in a known manner in engine body 12, between cylinder head 14 and the engine block (not shown). At least a portion of at least one coolant passage, e.g., coolant passages 36 and 42, extend in a longitudinal direction in a portion of cylinder head 14 alongside or adjacent to mounting bore 30. At least a portion of at least one coolant passage, e.g., coolant passages 38 and 44, extend generally transverse to mounting bore 30 in a portion of cylinder head 14 that is at least partially alongside combustion chamber 34. Engine body 12 further includes a low-pressure engine drain circuit 94 including an engine drain passage 93 connected to a low-pressure drain, e.g., an engine fuel sump.

Throughout this specification, distal refers to a longitudinal direction toward the combustion chamber 34. Proximal refers to a longitudinal direction away from the combustion chamber 34.

Injector body 20 includes a longitudinal axis 48 extending along the length of injector body 20, an upper body or barrel portion 49, an outer housing or retainer 50, and a lower body portion 59. Injector body 20 further includes a fuel delivery circuit 54, one or more injector orifices 56 positioned at a distal end of lower body portion 59, and an upper cavity 137 positioned between control valve assembly 28 and upper body portion 49. Lower body portion 59 includes a nozzle housing 57, and an injector cavity 52 located within nozzle housing 57. Injector orifice(s) 56 communicate with one end of injector cavity 52 to discharge fuel from fuel delivery circuit 54 into combustion chamber 34. Outer housing 50 secures upper body portion 49, injection control valve assembly 28, and lower body portion 59 in compressive abutment. In addition to locating the elements of fuel injector 18, outer housing 50 includes an interior surface 53, an exterior surface 55, a transversely or radially extending outlet port 51 positioned between interior surface 53 and exterior surface 55, and an internal thread 61. Upper body portion 49 includes an external thread 65 that mates with outer housing internal threads 61 when outer housing 50 is attached to upper body portion 49.

Nozzle valve element 22 is positioned in one end of injector cavity 52 adjacent injector orifice 56. Nozzle valve element 22 is movable between an open position in which fuel may flow through injector orifice 56 into combustion chamber 34 and a closed position in which fuel flow through injector orifice 56 is blocked.

Nozzle valve element 22 extends into a nozzle element cavity 58 formed within a nozzle element guide 60. Control volume 24 is formed between an end of nozzle valve element 22 and a distal end of a valve housing 88, described herein elsewhere, and by an interior of nozzle element guide 60. Nozzle element guide 60 includes a transverse guide passage 67. Control volume 24 receives high-pressure fuel from injector cavity 52 by way of transverse guide passage 67. The pressure of fuel in control volume 24 determines whether nozzle valve element 22 is in an open position or a closed position, which is further determined by injection control valve assembly 28, described in more detail herein elsewhere. When nozzle valve element 22 is positioned in injector cavity 52, nozzle element guide 60 is positioned longitudinally between nozzle valve element 22 and injection control valve assembly 28. Other servo controlled nozzle valve assemblies may be used, such as those disclosed in U.S. Pat. No. 6,293,254, the entire content of which is hereby incorporated by reference.

Fuel delivery circuit 54 is positioned to connect high-pressure fuel from fuel system 16 to injector cavity 52 and control volume 24. Fuel delivery circuit 54 includes a plurality of longitudinally extending fuel delivery passages 86 extending through injection control valve assembly 28 to provide high-pressure fuel to injector cavity 52 and control volume 24. Injection control valve assembly 28 is positioned along drain circuit 26 and includes a valve housing 88 having a valve cavity 96 formed by a valve housing interior surface 91, a fuel injector control valve 95 positioned within valve cavity 96, and a contact spring 144. Valve housing 88 further includes a control valve seat 122, at least one circumferential slot 148, and a longitudinal slot 150.

Valve housing 88 is positioned along longitudinal axis 48 between upper body portion 49 and lower body portion 59, and in compressive abutment with upper body portion 49 and lower body portion 59 to create a force load on valve housing 88. The force load on valve housing 88 is caused by a first load force and a second load force. During assembly, lower body portion 59 is positioned in a distal end of outer housing 50. Next, injection control valve assembly 28 is positioned along longitudinal axis 48 immediately adjacent to and in abutting contact with lower body portion 59 in outer housing 50. Outer housing portion 50 is secured to upper body portion 49 by outer housing internal threads 61 and upper body portion external threads 65, placing upper body portion 49 in abutting contact with valve housing 88 and transmitting a first load force through valve housing 88. When fuel injector 18 is mounted within engine body 12, fuel injector 18 is secured in engine body 12 by a clamping load 47, which is a second load force. Another clamping load or force may be applied in various other locations on injector body 20, such as at location 69 on outer housing 50. Clamping load 47 may extend through upper body portion 49, valve housing 88, and lower body portion 59. The clamp force transmitted through lower body portion 59 is transmitted to engine body 12.

Injector control valve 95 includes a control valve member 90 and an actuator 92 positioned in valve housing 88. Actuator 92 is adapted to cause movement of control valve member 90 between a first, closed position and a second, open position. Control valve member 90 is positioned in valve cavity 96 to move reciprocally between the open position permitting flow through drain circuit 26 and the closed position blocking flow through drain circuit 26. Actuator 92 includes a solenoid assembly 108 that includes a stator housing 109 having a first end 112 and a second end 114, a proximal end 129 of the valve housing 88, a stator 110 positioned in stator housing 109, a coil 116 positioned circumferentially in and around stator 110, and an armature 106 operably connected to control valve member 90. Stator housing 109 is positioned in valve cavity 96 of valve housing 88 and stator housing 109 includes a stator housing exterior surface 111 extending between stator housing first end 112 to stator housing second end 114. Stator housing 109 further includes a central core 118 formed as an aperture or bore extending through stator housing 109 from first end 112 to second end 114, and a transversely extending stator passage 117. Central core 118 includes a spring cavity 125 and is positioned to receive control valve member 90. An annular stator housing passage 113 is formed between valve housing interior surface 91 and exterior surface 111 of stator housing 109. In the exemplary embodiment, annular stator housing passage 113 is formed on exterior surface 111 of stator housing 109. Valve housing interior surface 91 is positioned a spaced transverse distance from exterior surface 111 of stator housing 109, forming an annular gap 127 along the entire axial extent of exterior surface 111 of stator housing 109. Annular gap 127 prevents mounting loads from being transmitted from valve housing 88 to stator housing 109 and permits air to travel between stator housing 109 and valve housing 88 to upper cavity 137 where the air remains or is dissolved into solution with the drain fuel over time.

When lower body portion 59, injection control valve assembly 28, and upper body portion 49 are assembled within outer housing 50, contact spring 144 is positioned along longitudinal axis 48 between stator housing 109 and upper body portion 49. Contact spring 144 provides a spring load to stator housing 109 to bias stator housing 109 toward a distal end of valve cavity 96. Contact spring 144 also isolates stator housing 109 from the compressive forces transmitted by assembly of lower body portion 59, injection control valve assembly 28, and upper body portion 49 in outer housing 50, as well as clamping load 47 when fuel injector 18 is assembled in engine body 12. The only longitudinal force transmitted to stator housing 109 is through contact spring 144 by way of the spring load of contact spring 144. When considered from the perspective of stator housing 109, stator housing 109 is positioned to receive only longitudinal forces transmitted through contact spring 144.

The force transmitted through valve housing 88 by installation of injection control valve assembly 28 into retainer outer housing 50 and the installation of fuel injector 18 in engine body 12 is significant and causes some compression of valve housing 88. However, valve housing 88 is structurally rigid and contact spring 144 is designed to provide a nominal bias on the components positioned within valve cavity 96. Thus, the additional compression of contact spring 144 by compression of structurally rigid valve housing 88 during assembly into outer housing 50 and during assembly of fuel injector 18 into engine body 12 transmits a negligible or structurally insignificant amount of load force through contact spring 144 to stator housing 109, effectively making stator housing 109 independent or free of mounting or clamp loads external to injection control valve assembly 28. Making stator housing 109 independent of mounting or clamp loads external to injection control valve assembly 28 ensures that the armature stroke and thus injector performance will not change due to mounting or clamping loads external to injection control valve assembly 28.

As perhaps best seen in FIG. 3, injection control valve assembly 28 may further include a cover plate 132 positioned longitudinally between upper body portion 49 and valve housing 88, which thus includes stator housing 109, and a plurality of retainers 134. Cover plate 132 includes a plurality of openings 133, a central opening 135, and a plurality of cover plate fuel passages 190. Retainers 134 include a thread 136 formed at a first or distal end of retainers 134, an interface portion 140, and a pin portion 142. Retainers 134 include a retainer longitudinal portion that extends between interface portion 140 and threads 136. The retainer longitudinal portion may be configured similarly to pin portion 142. Valve housing 88 includes a plurality of threaded recesses 138 having threads that mate with threads 136. The first or distal end of retainers 134 extend through openings 133 formed in cover plate 132 to engage with threaded recesses 138. Interface portion 140 is shaped to mate with an adjusting tool (not shown) that permits retainers 134 to be tightened securely to valve housing 88.

Cover plate fuel passages 190 align with fuel delivery passages 86, and thus may be considered an extension of injection fuel delivery passages 86 through cover plate 132, and cover plate fuel passages 190 are thus included in fuel delivery circuit 54. Cover plate fuel passages 190 are positioned in cover plate 132 in an arc segment configuration, with the arc segment configuration having a first end 192 and a second end 194. It should be apparent that fuel delivery passages 86 are also arranged in an arc segment in at least the portion of fuel injector body 20 adjacent to cover plate 132. Cover plate 132 includes a plurality of interior injector passage surfaces 196, as shown in FIG. 5, each interior injector passage surface 196 forming a cover plate fuel passage 190. In the exemplary embodiment, a transverse orifice wall 198 extends from injector passage surface 196 in fuel passage 190 at first end 192 and a transverse orifice wall 198 extends from injector passage surface 196 in fuel passage 190 at second end 194. Each transverse orifice wall 198 includes a longitudinally extending orifice surface 202 extending therethrough to form an orifice or restriction 200. In the exemplary embodiment, orifice surface 202 extends perpendicularly to transverse orifice wall 198.

Each orifice 200 is sized to restrict the velocity of fuel flow through the fuel passage 190, reducing the propagation of pressure waves and controlling the amount of pressure pulsation dampening. The intersection of orifice surface 202 with transverse orifice wall 198 forms an upper edge 204 and a lower edge 206. The amount of pressure pulsation dampening performed by each orifice 200 may be tuned by adjusting the radii corresponding to cross-sectional areas of upper edge 204 and lower edge 206. In an exemplary embodiment, the radius of the upper edge 204 and lower edge 206 are each less than 0.002 inches. In various other embodiments (not shown), the orifice 200 is a nozzle having one edge of the orifice 200 with a different radius than the other edge, thereby biasing the pressure pulsation dampening in one direction.

Each cover plate passage 190 includes a passage cross sectional flow area, and each orifice 200 includes an orifice cross sectional flow area. In an exemplary embodiment, each passage cross sectional flow area is identical. As with the radius of upper edge 204 and lower edge 206, the ratio of the orifice cross sectional flow area to the passage cross section flow area may be adjusted during design to control the amount of pressure pulsation dampening. The selection of a practical ratio depends at least on the fueling requirements, number of fuel passages 90, and size of the volumes being connected, for example the injector cavity 52 and the fuel system 16. In an exemplary embodiment, the orifice cross sectional flow area is approximately 6.25% of the passage cross sectional flow area. Each cover plate passage 190 and each orifice 200 in the exemplary embodiment is annular. However, cover plate passage 190 and orifice 200 may be other shapes. In an exemplary embodiment, the orifice 200 has a length in the longitudinal direction and a diameter in the transverse direction and is sharp-edged cylindrical orifice having a length-to-diameter ratio about less than 10.

Figure 4:
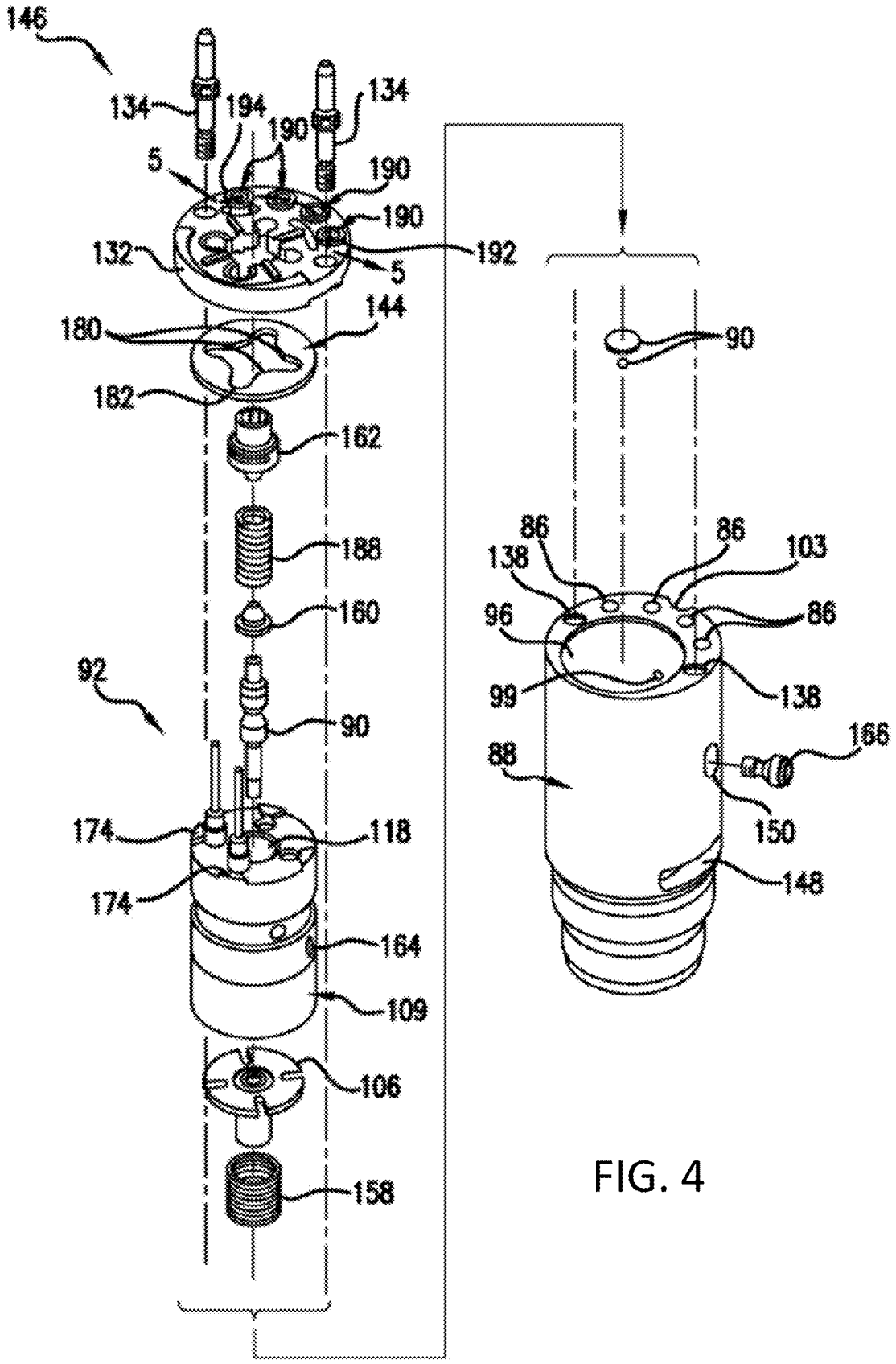
FIG. 4 is a perspective exploded view of the control valve assembly of the fuel injector of FIG. 2.

In the exemplary embodiment, perhaps as best shown in FIGS. 3 and 4, cover plate 132 is mounted in abutment to the proximal end 129 of valve housing 88 by retainers 134. Once cover plate 132 is securely connected to valve housing 88, contact spring 144 is compressed between cover plate 132 and stator housing 109 to provide a spring force or load on stator housing 109. Contact spring 144 is therefore positioned longitudinally between stator housing 109 and cover plate 132, and the components positioned in valve cavity 96, including control valve member 90 and actuator 92, are positioned within valve housing 88 to form a self-contained valve cartridge assembly 146. Because injection control valve cartridge assembly 146 is formed as a single integrated unit or a complete assembly, it may be easily installed or inserted within outer housing 50. Upper body portion 49 contains recesses (not shown) that mate with pin portion 142 to provide proper orientation of barrel or upper body portion 49 with cartridge assembly 146. Because cover plate 132 retains contact spring 144 in position, the spring load or force provided by contact spring 144 on stator housing 109 is fixed during assembly of cartridge assembly 146 in fuel injector 18. Furthermore, and as previously described, contact spring 144 maintains the spring load independent of compressive mounting loads that originate outside valve cartridge assembly 146.

Injection control valve assembly 28 further includes an armature bias spring 158, a bias spring guide 160, a spring preload adjustment device 162 having external threads 168, an anti-rotation fastener 166, a plurality of electrical connections 178 extending longitudinally from stator housing 109, and a control valve member bias spring 188. Armature bias spring 158 is positioned along longitudinal axis 48 between armature 106 and a distal portion of control valve member 90. Control valve member 90 is positioned in armature 106 and retained in armature 106. Control valve member 90 and armature 106 are positioned in valve cavity 96 such that a distal end of control valve member 90 is in contact with control valve seat 122. Stator housing 109, which receives stator 110 and coil 116, is then positioned in valve cavity 96, receiving control valve member 90 in central core 118 as stator housing 109 is inserted or slid into valve cavity 96. Stator housing 109 further includes a threaded stator housing recess 164. When stator housing 109 is positioned in valve cavity 96, threaded stator housing recess 164 is positioned to align with longitudinal slot 150. Threaded stator housing recess 164 receives anti-rotation fastener 166, the head of which has sufficient clearance to permit the head to slide freely in longitudinal slot 150.

Bias spring guide 160 is positioned over a proximal end of control valve member 90 in central core 118 of stator housing 109. Central core 118 next receives control valve member bias spring 188, which abuts bias spring guide 160. Spring cavity 125 of central core 118 includes an internally threaded portion 170 that receives and engages external threads 168 of spring preload adjustment device 162. Spring preload adjustment device 162 is secured fully within spring cavity 125 to await further adjustment to set the spring force on control valve member 90, which determines the opening characteristics of fuel injector control valve 95. Once stator housing 109 is positioned in valve cavity 96, a contact spring cavity 172 is located longitudinally between a proximal end of stator housing 109 and the proximal end 129 of valve housing 88 and contact spring cavity 172 receives contact spring 144. Stator housing 109 further includes a plurality of lands 174, which are in abutting contact with a distal side of contact spring 144 when contact spring 144 is positioned in contact spring cavity 172. Cover plate 132, which is identical on the proximal and the distal sides, includes a plurality of transversely extending cover plate lands 176. When cover plate 132 is positioned adjacent valve housing 88, cover plate 132 is rotationally oriented by engaging with electrical connections 178 and more accurately located by retainers 134.

The engagement of cover plate 132 with electrical connections 178 orients cover plate lands 176 circumferentially to extend radially between stator housing lands 174 when viewed from the proximal end of injection control valve assembly 28. In the exemplary embodiment, contact spring 144 is a washer shaped in the form of a disk having a circumferential periphery. Contact spring 144 includes a plurality of radially inward portions 180 and a plurality of radially outward portions 182 positioned circumferentially about 45 degrees from radially inward portions 180 positioned radially adjacent an open interior of contact spring 144. Radially inward portions 180 appear as tabs in the open interior of contact spring 144. Cover plate lands 176 contact radially inward portions 180 on a proximal side of cover plate 132 and stator housing lands 174 contact radially outward portions 182 on a distal side of cover plate 132. Retainers or fasteners 134 are now inserted through cover plate 132, received by threaded recesses or cavities 138 formed in valve housing 88. Retainers 134 are tightened to secure cover plate 132 in abutting contact with valve housing 88, which also causes a preload force to be exerted on contact spring 144, providing a bias to stator housing 109 to secure stator housing 109 in valve cavity 96. While the exemplary embodiment uses spacer plate 132, in another embodiment the features on spacer plate 132 may be provided on upper body 49, which may be in a direct abutting relationship with valve housing 88.

When fuel injector 18 is clamped into place, a clamp load is directed through a plurality of cover plate lands 176 between a plurality of stator housing lands 174. Due to the thickness of contact spring 144 and the position of the load applied by cover plate lands 176 on contact spring 144 with respect to the supporting stator housing lands 174, contact spring 144 deflects or bends. This configuration permits only a negligible amount of the clamping load 47 to reach stator housing 109. Note that the thickness of contact spring 144 and the height of lands 176 directly affect the amount of clamp load force transmitted to stator housing 109. With a thinner contact spring 144 and a shorter longitudinal height for cover plate lands 176, the amount of clamp load transmitted through contact spring 144 is decreased. The choice of material for contact spring 144 also affects the clamp load transmitted.

Once control valve assembly 28 is assembled, control valve assembly 28 may be positioned within a test fixture and spring preload adjustment device 162 may be adjusted. By adjusting spring preload adjustment device 162, the preload of control valve member bias spring 188 is adjusted, which affects the on time of a fuel injector. Simultaneous to adjusting the armature stroke and the spring preload, the performance characteristics of control valve assembly 28 may be measured. Once the spring preload has been adjusted, control valve assembly 28 is ready to be installed in fuel injector 18.

Valve housing 88 further includes a transversely or radially extending flow passage 98 connecting valve cavity 96 to an exterior of valve housing 88, a longitudinally extending first drain passage 100, and one or more relief passages 99. A longitudinally or axially inwardly extending flow passage 102 is provided to connect transversely extending passage 98 to outlet port 51. Inward flow passage 102 is formed between an exterior surface 89 of valve housing 88 and interior surface 53 of outer housing 50. In the exemplary embodiment, flow passage 102 includes an axial groove 103 formed in valve housing 88. Valve housing 88 also includes axially extending fuel delivery passage(s) 86, which are part of fuel delivery circuit 54. Axially inward flow passage 102 is positioned circumferentially adjacent to at least one fuel delivery passage 86, and may be positioned circumferentially adjacent to two fuel delivery passages 86. Transverse flow passage 98 is positioned a spaced circumferential distance from axially extending fuel delivery passages 86. Thus, transverse flow passage 98 extends between two adjacent fuel delivery passages 86, as best seen in FIG. 3. Transverse flow passage 98 is also positioned longitudinally in a location that is transversely adjacent to armature 106, and, more specifically, is transversely or radially adjacent to the portion of valve cavity 96 that is adjacent armature 106, and more specifically, a distal surface 107 of armature 106. Because fuel injector 18 is typically operated in the orientation shown in FIG. 1, transverse flow passage 98 is also adjacent a portion of valve cavity 96 that is below or under distal surface 107 of armature 106. First drain passage 100 is positioned to connect injector cavity 52 to valve cavity 96.

Drain circuit 26 extends from control volume 24 through injection control valve assembly 28, through outer housing 50 into mounting bore 30, to engine drain passage 93 of low-pressure engine drain circuit 94. More specifically, drain circuit 26 includes first drain passage 100, valve cavity 96, transverse flow passage 98, axially inward flow passage 102, and outlet port 51. Outlet port 51 is positioned longitudinally between injector orifice(s) 56 and actuator 92, and may be positioned longitudinally between injector orifice(s) 56 and control valve member 90. When fuel injector 18 is positioned in mounting bore 30, outer or exterior surface 55 of outer housing 50 is positioned adjacent to inner surface 32 of mounting bore 30, and an axially extending drain passage 130 is formed by exterior surface 55 of outer housing 50 and inner surface 32 of mounting bore 30. As described further hereinbelow, axial drain passage 130 is included as a part of drain circuit 26. Axial drain passage 130 overlaps at least one engine body coolant passage, e.g., coolant passage 45, in an axial direction, which means that axial drain passage 130 and coolant passage 45 are side-by-side or radially adjacent for at least a portion of axial drain passage 130. Axial drain passage 130 is positioned longitudinally between actuator 92 and injector orifice 56. More specifically, axial drain passage 130 extends longitudinally from outlet port 51 to a location adjacent engine drain passage 93 to permit fluid communication between outlet port 51 and engine drain passage 93.

When fuel injector control valve 95 is energized by an engine control system (not shown), actuator 92 is operable to move armature 106 longitudinally toward stator 110. Movement of armature 106 causes control valve member 90 to move longitudinally away from control valve seat 122, which causes drain circuit 26 to be connected with control volume 24. Fuel is immediately able to flow outwardly through first drain passage 100, between control valve member 90 and control valve seat 122, and into valve cavity 96. Transverse flow passage 98 is in fluid communication with valve cavity 96 at an upstream or first end and with axially inward flow passage 102, and thus engine drain passage 93 of low-pressure drain 94, at a downstream or second end, receiving fuel flow from valve cavity 96. The first end of transverse flow passage 98 opens into valve cavity 96 in a location that is radially adjacent to armature 106, and more specifically, to distal surface 107 of a transverse portion 115 of armature 106. The fuel flows radially or transversely through transversely extending flow passage 98, moving from valve cavity 96 into axially inward flow passage 102.

Because drain fuel flows directly from valve cavity 96 to axially inward flow passage 102 by way of transversely extending flow passage 98, the hot drain fuel is directed away from solenoid assembly 108, reducing the heat transferred from the hot drain fuel to solenoid assembly 108. In addition to reducing heat transfer to solenoid assembly 108, the location of transversely extending passage 98 is advantageous in that the drain fuel is able to carry air and debris away from components such as armature 106 and stator 110, potentially improving the reliability and durability of these components. Additionally, since transverse flow passage 98 is positioned circumferentially adjacent or between fluid delivery passage 86, there is some heat transfer from the hot drain fuel to the cooler fuel in fluid delivery passage 86, providing cooling to the hot drain fuel. Once in axially inward flow passage 102, fuel flows longitudinally or axially inwardly in a direction that is toward outlet port 51, where the fuel flows into outlet port 51. Axial drain passage 130 receives the drain fuel from outlet port 51, directing the drain fuel longitudinally or axially inwardly in a direction that is toward the distal end of fuel injector 18, which is toward injector orifices 56. The fuel then flows into engine drain passage 93 of low-pressure engine drain circuit 94. Thus, drain circuit 26 is positioned to receive drain fuel from control volume 24 and to drain the fuel toward low-pressure engine drain circuit 94.

With connection of control volume 24 to engine drain circuit 94, fuel pressure in control volume 24 is significantly reduced in comparison to fuel pressure in injector cavity 52. The pressure on the distal end of nozzle valve element 22 is significantly greater than the pressure on a proximal end of nozzle valve element 22, forcing nozzle valve element 22 longitudinally away from injector orifices 56, and permitting high-pressure fuel flow from injector cavity 52 into combustion chamber 34, thus injecting fuel under high pressure into combustion chamber 34. When actuator 92 is de-energized, control valve member 90 is biased by control valve member bias spring 188 to cause injector control valve 95 to close. When fuel injector control valve 95 is closed, pressure builds in control volume 24, causing, in combination with a nozzle element bias spring 128, nozzle valve element 22 to move longitudinally toward injector orifices 56, closing or blocking injector orifices 56.

During operation, control valve member 90 moves up and down, causing a pumping action to occur in spring cavity 125. Stator passage 117 is positioned to connect spring cavity 125 to annular gap 127 and to one or more relief passages 99 formed in valve housing 88, thus providing an unrestricted venting of spring cavity 125, which allows unencumbered movement of control valve member 90.

Figure 6:
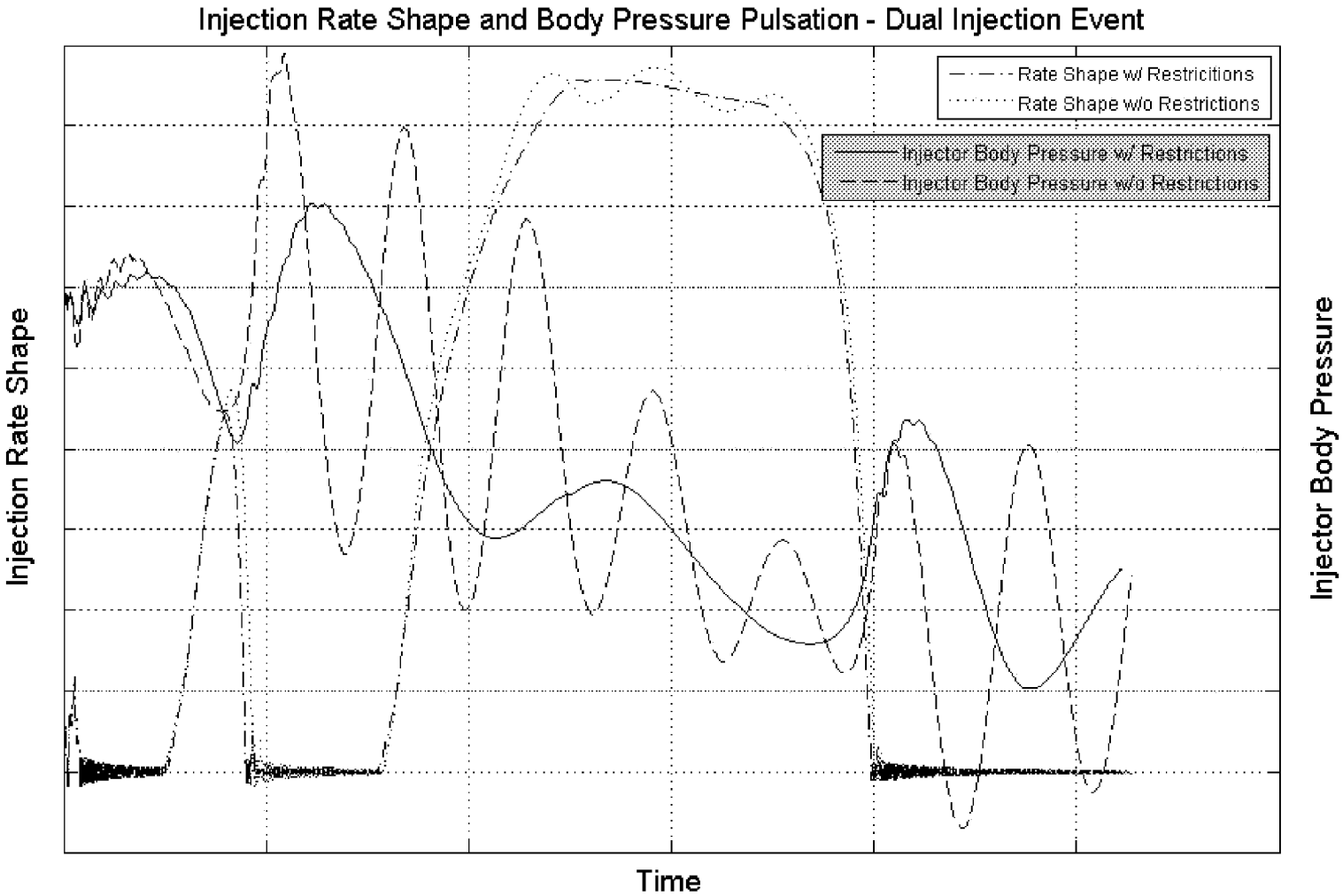
FIG. 6 is a graph showing a comparison between injection rate shape and injection body pressure versus time achieved using a fuel injector according to various embodiments of the present disclosure and a conventional fuel injector.
Figure 7:
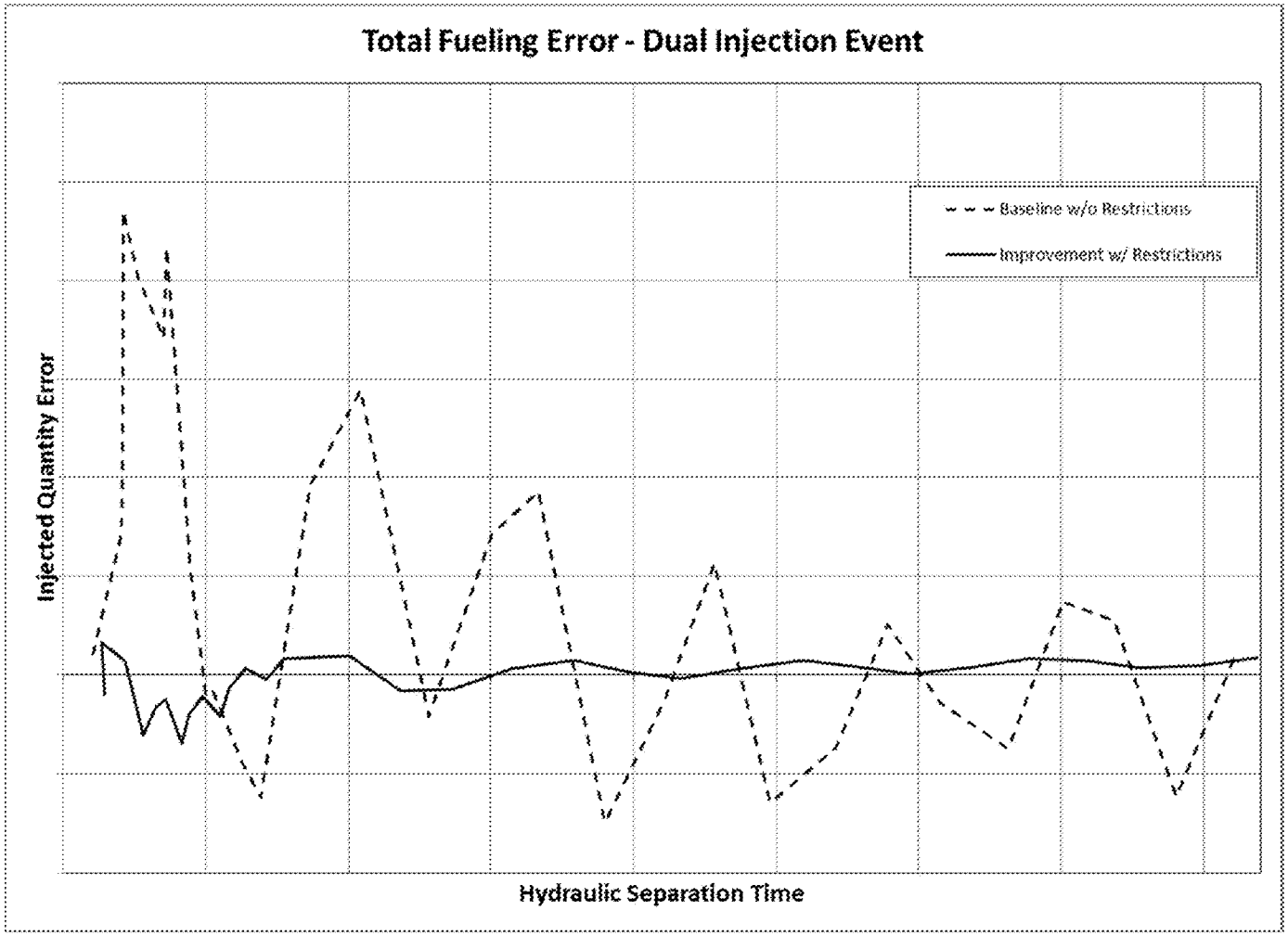
FIG. 7 is a graph showing a comparison between injected quantity error versus hydraulic separation time achieved using a fuel injector according to various embodiments of the present disclosure and a conventional fuel injector.

FIGS. 6 and 7 are graphs showing results achieved with an improved fuel injector according to various embodiments of the present disclosure and a conventional fuel injector. The conventional and improved fuel injectors are similar except that the improved fuel injector has restrictions in the fuel delivery passages 86 created by the orifices 200.

FIG. 6 shows injection rate shape and injection body pressure versus time during an injection event having a first injection and a second or main injection representing a greater injection volume for conventional and improved fuel injectors. Results for a conventional fuel injector are represented by plot lines indicating a fuel injector "without restrictions," and results for an improved fuel injector are represented by plot lines indicating a fuel injector "with restrictions."

As shown, the body pressure in the conventional fuel injector begins to pulsate after the first injection. This pulsation affects the timing and peak delivery rate, and thus total delivered quantity, of the main injection. The pulsations have an amplitude and frequency. For the improved fuel injector, body pressure also pulsates after the first injection event, and the average pressure over time is substantially similar to that for the conventional fuel injector. However, the amplitude and frequency of the pulsations are reduced in the improved fuel injector, or in other words, the pulses are dampened.

FIG. 7 shows injected quantity error versus hydraulic separation time of the same conventional and improved fuel injectors of FIG. 6. The injected quantity error is the variation in total injected quantity from two injection events. Comparing the results for the improved fuel injector and the conventional fuel injector, the variation in injected quantity error is much lower for the improved fuel injector resulting in consistency when fuel delivery to the combustion chamber of the engine 10. Consistency enables better fuel economy, emissions, and NVH performance over a broad range of engine conditions.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A fuel injector for injecting fuel at high pressure into a combustion chamber of an internal combustion engine, comprising:

an injector body including a longitudinal axis, an upper body portion, a lower body portion, a fuel delivery circuit, and an injector orifice to discharge fuel from the fuel delivery circuit into the combustion chamber, the fuel delivery circuit including an injector cavity within the lower body portion and a plurality of injection fuel delivery passages extending longitudinally in the injector body in fluid communication with the injector cavity to deliver injection fuel to the injector orifice, each of the plurality of injection fuel delivery passages extending through the upper body portion from a proximal end of the fuel injector to the injector orifice and including a passage cross sectional flow area, and at least one and less than a total number of the plurality of injection fuel delivery passages includes an orifice defined by the injector body having an orifice cross sectional flow area less than the passage cross sectional flow area and sized to reduce propagation of pressure waves.

2. The fuel injector of claim 1, the injector body further including a cover plate positioned between the upper body portion and the lower body portion, the injection fuel delivery passages extending through the cover plate and at least one orifice being defined by the cover plate.

3. The fuel injector of claim 2, the cover plate being attached to the lower body portion to form a valve assembly.

4. The fuel injector of claim 3, the valve assembly including a stator housing, and the cover plate places a load on the stator housing.

5. The fuel injector of claim 4, including a contact spring positioned longitudinally between the cover plate and the stator housing to impart a spring load to the stator housing.

6. The fuel injector of claim 2, wherein the plurality of injection fuel delivery passages is arranged in the cover plate in an arc segment when viewed along the longitudinal axis, the arc segment having a first end and a second end.

7. The fuel injector of claim 6, including at least three injection fuel delivery passages, and the injection fuel delivery passage at the first end and the injection fuel delivery passage at the second end each includes one orifice.

8. The fuel injector of claim 2, wherein the plurality of injection fuel delivery passages is four injection fuel delivery passages and the number of orifices is in the range one to three.

9. The fuel injector of claim 8, wherein the plurality of injection fuel delivery passages is four injection fuel delivery passages and the number of orifices is two.

10. The fuel injector of claim 9, wherein the plurality of injection fuel delivery passages is arranged in an arc segment when viewed along the longitudinal axis, the arc segment having a first end and a second end, and the orifices are positioned in the injection fuel delivery passage at the first end and the injection fuel delivery passage at the second end.

11. A fuel injector comprising:

an injector body including a longitudinal axis, an upper body portion, a lower body portion, a fuel delivery circuit, and an injector orifice to discharge fuel from the fuel delivery circuit into a combustion chamber, the fuel delivery circuit including an injector cavity and a plurality of injection fuel delivery passages extending longitudinally in the injector body in fluid communication with the injector cavity to deliver injection fuel to the injector orifice, each of the plurality of injection fuel delivery passages extending through the upper body portion from a proximal end of the fuel injector to the injector cavity and including a passage cross sectional flow area, and at least one and less than a total number of the plurality of injection fuel delivery passages includes an orifice defined by the injector body as a sharp-edged orifice including an orifice cross-sectional flow area and an orifice wall extending transversely and radially inward, wherein each transverse orifice wall includes an orifice surface extending perpendicular to the transverse orifice wall and forming the orifice.

12. The fuel injector of claim 11, the injector body further including an injection control valve assembly including a valve housing positioned along the longitudinal axis in compressive abutment between the upper body portion and the lower body portion to create a force load on the valve housing, the injection control valve assembly further including a control valve member positioned in the valve housing to move between a first position and a second position, and an actuator positioned in the valve housing and adapted to cause movement of the control valve member between the first and the second positions, the actuator including a stator housing positioned in the valve housing, and a stator positioned in the stator housing, the injection control valve assembly further including a contact spring positioned longitudinally between the stator housing and the upper body portion to impart a spring load to the stator housing, the injection control valve assembly further including a cover plate positioned longitudinally between the upper body portion and the valve housing, the contact spring being positioned longitudinally between the cover plate and the stator housing, the injection fuel delivery passages extending through the cover plate and at least one orifice being defined by the cover plate.

13. The fuel injector of claim 11, wherein the orifice cross sectional flow area is about 6.25% of the passage cross sectional flow area.

14. The fuel injector of claim 11, wherein the passage cross sectional flow area of each fuel delivery passage is about the same diameter.

15. The fuel injector of claim 11, the injector body including a plurality of injector passage surfaces forming the plurality of injection fuel delivery passages, each orifice being formed in one orifice wall, the intersection of each transverse orifice wall and each orifice surface forming an upper edge and a lower edge.

16. The fuel injector of claim 15, each of the upper edge and the lower edge having a radius less than 0.002 inches.

17. The fuel injector of claim 15, the upper edge having a first radius, the lower edge having a second radius, the first radius not equal to the second radius.

18. A fuel injector comprising:

an injector body including a fuel delivery circuit, an upper body portion, a lower body portion in which is positioned the injector cavity, a cover plate positioned between the upper body portion and the lower body portion, and an injector orifice to discharge fuel from the fuel delivery circuit into a combustion chamber, the fuel delivery circuit including an injector cavity and a plurality of injection fuel delivery passages extending longitudinally in the injector body and through the cover plate in fluid communication with the injector cavity to deliver injection fuel to the injector orifice, wherein means for reducing propagation of pressure waves are located in the cover plate in at least one and less than a total number of the plurality of injection fuel delivery passages and each of the plurality of injection fuel delivery passages extending through the upper body portion from a proximal end of the fuel injector to the injector cavity and including a passage cross sectional flow area.

* * * * *